US010441047B2

(12) United States Patent
Egner

(10) Patent No.: US 10,441,047 B2
(45) Date of Patent: Oct. 15, 2019

(54) CUSTOMIZABLE HAIR CLIP ASSEMBLY

(71) Applicant: Olivia Egner, Yardley, PA (US)

(72) Inventor: Olivia Egner, Yardley, PA (US)

( * ) Notice: Subject to any disclaimer, the term of this patent is extended or adjusted under 35 U.S.C. 154(b) by 621 days.

(21) Appl. No.: 15/227,591

(22) Filed: Aug. 3, 2016

(65) Prior Publication Data

US 2017/0224079 A1 Aug. 10, 2017

Related U.S. Application Data

(60) Provisional application No. 62/291,008, filed on Feb. 4, 2016.

(51) Int. Cl.

| | |
|---|---|
| ***A45D 8/00*** | (2006.01) |
| ***A45D 8/14*** | (2006.01) |
| ***A45D 8/08*** | (2006.01) |
| ***A45D 8/36*** | (2006.01) |

(52) U.S. Cl.

CPC ..... *A45D 8/14* (2013.01); *A45D 8/08* (2013.01); *A45D 8/36* (2013.01); *A45D 2008/006* (2013.01)

(58) Field of Classification Search

CPC .... A61C 8/14; A61C 8/08; A61C 8/36; A61C 2008/006; A45D 8/14; A45D 8/08; A45D 8/36; A45D 2008/006; B42F 1/02; B42F 1/04; B42F 1/06; B42F 1/08

See application file for complete search history.

(56) References Cited

U.S. PATENT DOCUMENTS

| | | | | |
|---|---|---|---|---|
| 6,082,371 | A | 7/2000 | Bader-Saltzman et al. | |
| 6,189,542 | B1 * | 2/2001 | Shepard | A45D 8/00 132/273 |
| 6,513,167 | B1 * | 2/2003 | Cheng | A45D 8/36 2/171 |
| 8,276,598 | B1 * | 10/2012 | Shepard | A45D 8/20 132/275 |
| 8,919,354 | B2 * | 12/2014 | Davis | A45D 8/36 132/275 |
| 9,392,848 | B2 * | 7/2016 | LeBlanc | A44C 1/00 |
| 9,949,551 | B1 * | 4/2018 | Boles | A45D 8/20 |
| 2009/0032044 | A1 | 2/2009 | Grimm | |
| 2010/0212685 | A1 | 8/2010 | Garza | |
| 2011/0219587 | A1 * | 9/2011 | Nizan | A41D 27/08 24/303 |
| 2014/0370229 | A1 * | 12/2014 | LeBlanc | A44C 1/00 428/99 |
| 2015/0273933 | A1 * | 10/2015 | Meninga | B44C 3/12 428/28 |
| 2016/0106192 | A1 * | 4/2016 | Swartz | A45D 8/36 132/275 |
| 2018/0064217 | A1 * | 3/2018 | Ambrose | A44C 17/0225 |

* cited by examiner

*Primary Examiner* — Nicholas D Lucchesi
(74) *Attorney, Agent, or Firm* — Panitch Schwarze Belisario & Nadel LLP

(57) ABSTRACT

A customizable hair clip assembly for connecting to a wearer's hair and providing a selective decorative aspect, including a hair clip able to releaseably attach to a wearer's hair having an indentation at a first end, a first decorative portion, and a magnetic portion secured to the first decorative portion. The indentation is configured to have substantially the same shape and size as the magnetic portion such that the magnetic portion can be substantially fully inserted into the indentation in a mounted configuration.

8 Claims, 8 Drawing Sheets

CUSTOMIZABLE HAIR CLIP ASSEMBLY

CROSS-REFERENCE TO RELATED APPLICATIONS

The present application claims the benefit of U.S. Provisional Patent Application No. 62/291,008, filed on Feb. 4, 2016 and titled "Customizable Hair Clip Assembly" the entire contents of which is incorporated herein by reference in its entirety.

BACKGROUND OF THE INVENTION

The preferred invention relates generally to a hair clip capable of attachment to a decorative piece of the wearer's choosing via a magnetic connection and having the ability to customize the hair clip by interchanging the decorative pieces with the clip.

Hair clips are generally known, such as the clip disclosed by U.S. Pat. No. 3,082,773. Typically, hair clips are of a purely utilitarian design, or contain only minor stylistic features that are fixed in place directly to the clip. As such, if a wearer is unhappy with the style of a particular hair clip, or wishes to change the style of a hair clip based upon an external factor such as his or her clothing, the wearer must obtain a new hair clip. Exchanging hair clips requires removing his or her hair from the original clip to apply the new clip. Exchanging hair clips to alter appearance also requires storage and purchase of numerous styles and designs on the hair clips. In addition, head bands with interchangeable components that utilize hook and loop material to selectively secure the components to the head bands are known. Use of hook and loop material to exchange components snags the users hair, resulting in pulled hair and discomfort for the user.

It is therefore desirable to design, construct and implement a hair clip which can accept numerous decorative elements, which are interchangeable without removing the hair clip from the wearer's hair and typically do not snag the user's hair, resulting in pulled hair. The preferred present invention addresses the deficiencies of the prior art devices.

BRIEF SUMMARY OF THE INVENTION

Briefly stated, a preferred embodiment of the present invention is directed to a customizable hair clip assembly for connecting to a wearer's hair and providing a selective decorative aspect, including a hair clip able to releaseably attach to a wearer's hair having an indentation at a first end, a first decorative portion, and a magnetic portion secured to the first decorative portion. The indentation is configured to have substantially the same shape and size as the magnetic portion such that the magnetic portion can be substantially fully and snugly inserted into the indentation in a mounted configuration.

In another aspect, the preferred invention is directed to a hair band assembly for fastening a wearer's hair and providing a selective decorative aspect. The hair band assembly includes a hair band configured to releaseably attach to a wearer's hair, a base having an indentation and being movably mounted to the hair band, a first decorative portion and a magnetic portion mounted to the first decorative portion. The hair band has a generally U-shape with a first end and a second end. The base is movable between a first stop proximate the first end and a second stop proximate the second end. The indentation is configured as substantially the same shape and size as the magnetic portion such that the magnetic portion can be substantially fully and snugly inserted into the indentation.

In a further aspect, the preferred invention is directed to a hair clip assembly for connecting to a wearer's hair and providing a selective decorative aspect. The hair clip assembly includes a hair clip configured to releaseably attach to a wearer's hair, a cup having a protrusion on one side and an indentation on an opposing side, a first decorative portion and a magnetic portion secured to the first decorative portion. The hair clip includes a first end and a hole proximate the first end. The indentation is configured as substantially the same shape and size as the magnetic portion such that the magnetic portion can be substantially fully inserted into the indentation. The hole is configured to have substantially the same shape and size as the protrusion. The protrusion is engaged within the hole such that the cup is engaged to or near the first end of the hair clip in a mounted configuration

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
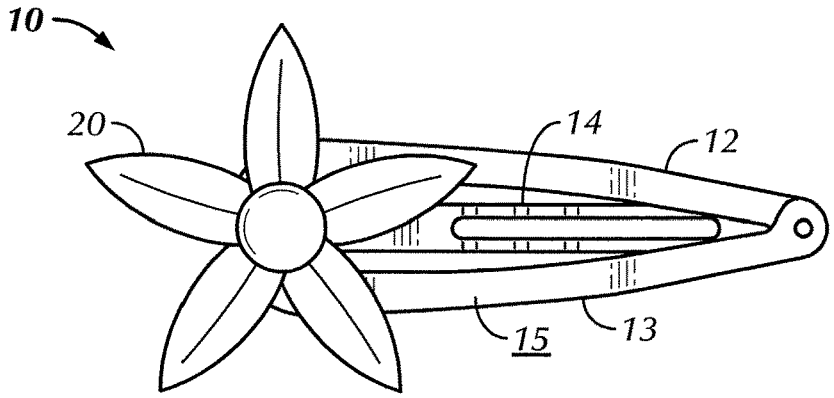
FIG. 1 is a top plan view of a hair clip assembly including a hair clip and a decorative portion in an attached configuration in accordance with a first preferred embodiment of the present invention.
Figure 2:
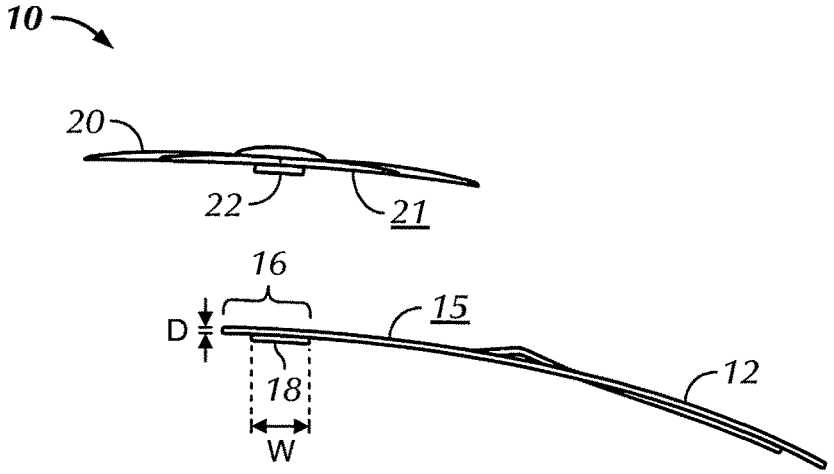
FIG. 2 is a side elevational view of the hair clip assembly of FIG. 1, wherein the hair clip and decorative portion are in a detached configuration.
Figure 3:
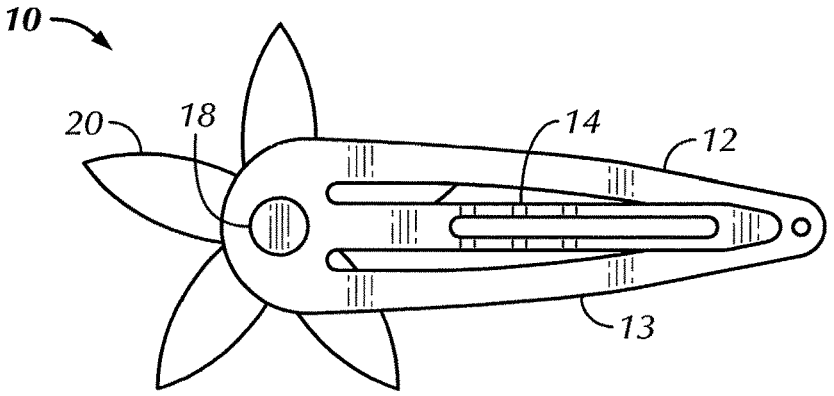
FIG. 3 is a bottom plan view of the hair clip assembly of FIG. 1, wherein the hair clip assembly is in the attached configuration.

Certain terminology is used in the following description for convenience only and is not limiting. Unless specifically set forth herein, the terms "a", "an" and "the" are not limited to one element but instead should be read as meaning "at least one". The words "right," "left," "lower," and "upper" designate directions in the drawings to which reference is made. The words "inwardly" or "distally" and "outwardly" or "proximally" refer to directions toward and away from, respectively, the geometric center or orientation of the device and related parts thereof. The terminology includes the above-listed words, derivatives thereof and words of similar import.

It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to FIGS. 1-4, a customizable hair clip assembly 10 in accordance with a first preferred embodiment can be used to contain a wearer's hair in a desired style or configuration while also displaying a selectively removable decorative element 20. The hair clip assembly 10 preferably includes a hair clip 12 capable of engagement with a wearer's hair and the selectively removable decorative element 20 or numerous different decorative elements 20. The hair clip 12 may be of any suitable configuration for engagement with a wearer's hair, such as that disclosed in U.S. Pat. No. 3,082,773. In such a configuration the hair clip 12 may contain an outer snapping member 13 and an inner pin member 14. In an open configuration (not shown), the outer snapping member 13 and inner pin member 14 are configured such that they are approximately forty-five degrees (45°) apart. A wearer can place hair sought to be contained therein between the outer snapping member 13 and inner pin member 14 and snap the outer snapping member 13 into the closed position. The outer snapping member 13 and inner pin member 14 are not limited to such open configurations and may only move slightly away from each other to accept the user's hair therebetween or may be configured to pivot nearly three hundred sixty degrees (360°) relative to each other, as long as the clip 12 is able to function to selectively be secured to the user's hair. Once snapped together, the outer snapping member 13 is arranged substantially adjacent to the inner pin member 14, containing the wearer's hair between the two. The hair clip 12 is preferably constructed of a lightweight metallic material, such as aluminum, but may be constructed of any material suitable for constraining a wearer's hair without deviating from the inventive concept, such as polymeric, other metals, composite materials or woods.

The hair clip 12 further preferably has a first end 16, which in turn preferably includes a first magnetic portion 18. The first magnetic portion 18 may be mounted on, integrally formed with, or engaged with the first end 16 in any suitable configuration for creating a magnetic surface on the first end 16 without deviating from the inventive concept. The first end 16 may itself be constructed of or contain a magnetic material, thereby enabling the first magnetic portion 18 to be integral to the first end 16. In addition, the magnetic portion 18 may be comprised of magnetic paint or a coating (not shown) that is secured to the outer surface of the hair clip 12 and provides magnetic attraction. The magnetic portion 18 may also be comprised of an indentation in the surface of the hair clip that receives a second magnetic portion 22 of the decorative portion 20. The indentation of the magnetic portion 18 allows consistent placement of the decorative portion 20 on the hair clip 12 and provides additional lateral engagement of the second magnetic portion 22 with the hair clip 12 to prevent the decorative portion 20 from being disengaged from the hair clip 12. Alternatively, the decorative portion 20 may include a magnetic indentation (not shown) that accepts a magnet mounted on the hair clip 12, without deviating from the preferred inventive concept described herein.

The hair clip assembly 10 also preferably includes a first decorative portion 20. The decorative portion 20 can be configured in any shape that is appealing to the wearer, designer or consumer, such as a flower, bow, jewel, feather, broach, ball, butterfly or nearly any desired decorative element that may match a user's outfit, have a team or group symbol or have nearly any predetermined theme. The first decorative portion 20 preferably contains a second magnetic portion 22. The second magnetic portion 22 enables the wearer to selectively attach the first decorative portion 20 to the hair clip 12 via the first magnetic portion 18. The first decorative portion 20 preferably includes a bottom surface 21 which substantially flushly abuts the top surface 15 of the hair clip 12 when arranged in an attached configuration. This preferred substantially flush configuration aids in achieving a slim profile of the attached configuration of the hair clip assembly 10 by minimizing any space between the hair clip 12 and first decorative portion 20. The second magnetic portion 22 may be mounted on, integrally formed with, or engaged with the first decorative portion 20 in any suitable configuration for creating a magnetic surface on the first decorative portion 20 without deviating from the inventive concept. The second magnetic portion 22 may also be comprised of a magnetic paint or coating that may be applied to the first decorative portion 20.

Figure 4:
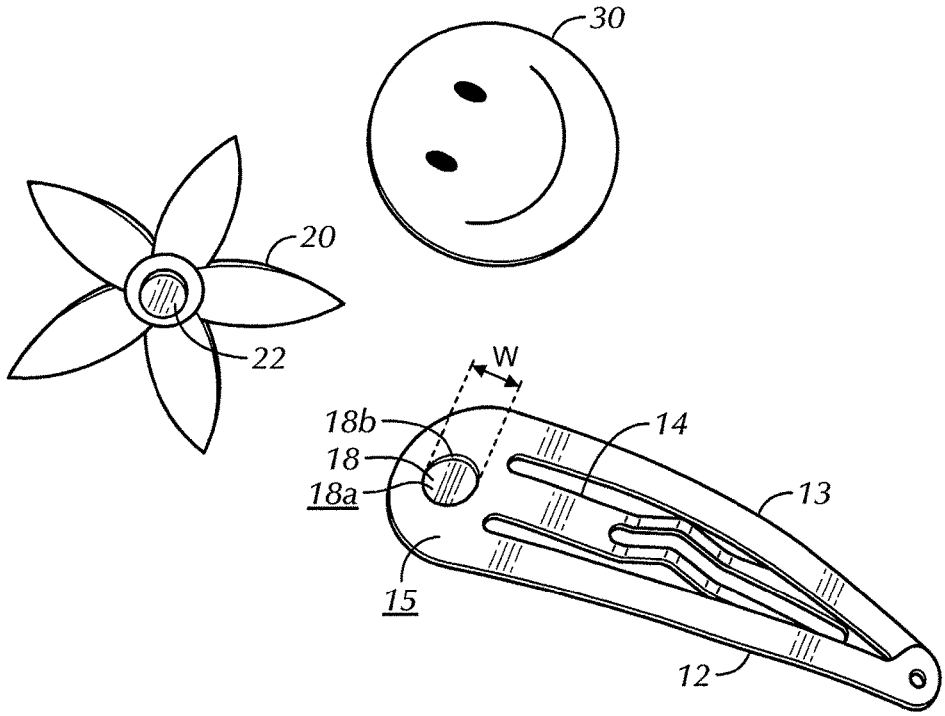
FIG. 4 is a partially exploded top perspective view of the hair clip assembly of FIG. 1, further including a second decorative portion, wherein the hair clip and the decorative portions are in a detached configuration.

Referring to FIG. 4, the hair clip assembly 10 is disclosed wherein the wearer also has the option to detach the first decorative portion 20 to wear the hair clip 10 without the first decorative portion 20 or to attach a second decorative portion 30 to the hair clip 12 at the first end 16 or in a different spot (not shown). The second decorative portion 30 preferably contains a third magnetic portion (not shown) that is mounted on, integrally formed with, or engaged with the second decorative portion 30 in any suitable configuration for creating a magnetic surface on the second decorative portion 30.

Referring to FIGS. 1-4, the hair clip 12 of the first preferred embodiment also preferably includes the first magnetic portion 18, which is formed as an indentation and is configured to receive the second magnetic portion 22 of the first decorative portion 20 and/or the third magnetic portion (not shown) of the second decorative portion 30. The first magnetic portion 18 is preferably comprised of a divot, indentation or impression in the clip 12 that preferably does not extend through the entire thickness of the clip 12. The first magnetic portion 18 preferably has a base surface 18*a* and side walls 18*b*. The base surface 18*a* is preferably spaced at a depth D of approximately one-sixteenth to one-eighth of one inch (1/16"-1/8") from the top surface 15 of the hair clip 12, but may be spaced at any depth which is capable of receiving the second magnetic portion 22 or third magnetic portion (not shown). The indentation further preferably has a diameter or width W in the range of approximately one-fourth to one-half of one inch (1/4"-1/2"), but may be of any diameter of width which is capable of receiving the second magnetic portion 22 or third magnetic portion (not shown). The first magnetic portion 18 is also preferably of a substantially similar shape and size as the second magnetic portion 22 so as to fully receive the second magnetic portion 22 therein when in a mounted configuration. The first magnetic portion 18 and the second magnetic portion 22 are preferably a generally cylindrical or parallelepiped shape to enable use with a cylindrical or circular magnet, but may also be of any suitable shape and size to achieve the purpose of the invention, such as square or rectangular to accept a square or rectangular magnet (not shown). The hair clip 12 is not, however, so limited. For example, the first decorative portion 20 may include the indentation or divot therein that accepts a protruding first magnetic portion 18 on the clip 12. Such configurations provide for a more flush engagement between the hair clip 12 and the first decorative portion 20 and/or the second decorative portion 30.

The hair clip assembly 10 may also be constructed with other attachment means for attaching the hair clip 12 to the decorative portion 20, without deviating from the inventive concept.

Figure 5:
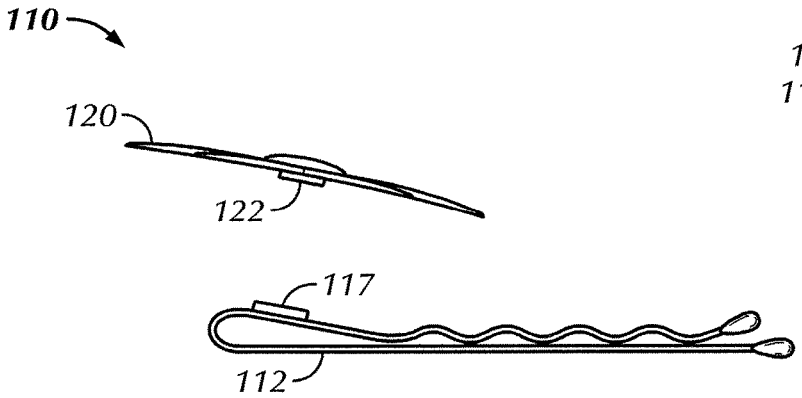
FIG. 5 is a side elevational view of a hair clip assembly including a bobby pin and a decorative portion in a detached configuration in accordance with a second preferred embodiment of the present invention.
Figure 6:
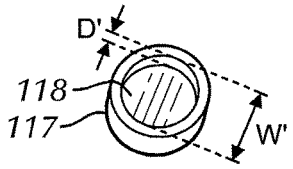
FIG. 6 is a top perspective view of a base of the hair clip assembly of FIG. 5.

Referring to FIGS. 5-6, a second preferred embodiment of the hair clip assembly 110 is shown. Like reference numbers are utilized to identify like features of the hair clip assembly 110 of the second preferred embodiment in comparison to the hair clip assembly 10 of the first preferred embodiment with a "1" prefix utilized to identify the features of the second preferred hair clip assembly 110. The second preferred embodiment includes a bobby pin 112 for releasably containing a wearer's hair in a desired style or configuration while also displaying a selectively removable decorative element 120. The bobby pin 112 of the second preferred embodiment is attached to a base 117 having a magnetic portion 118 for receiving a second magnetic portion 122 of a decorative portion 120. The magnetic portion 118 includes a base surface 118*a* and side walls 118*b*. The base 117 and magnetic portion 118 of the second preferred embodiments preferably have the same or a similar shape, size, and other characteristics and capabilities of the magnetic portion 18 of the first preferred embodiment. The base 117 can alternately be configured as a decorative shape, such as a heart or flower, without deviating from the inventive concept.

Figure 7:
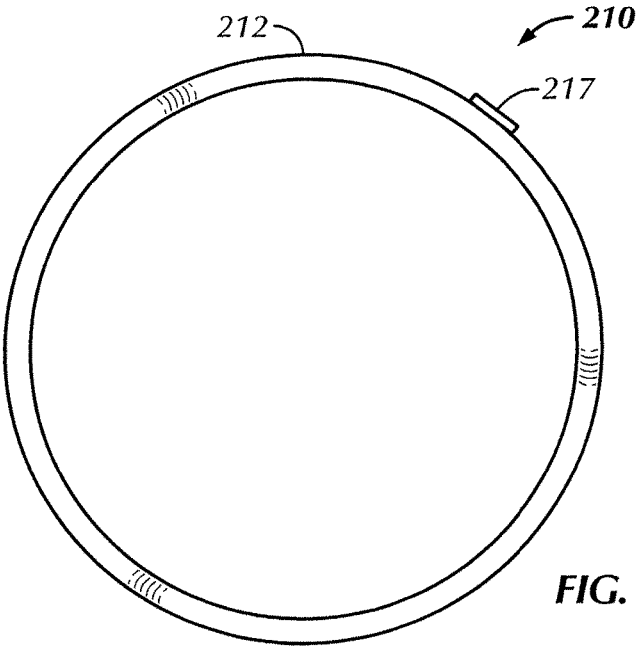
FIG. 7 is a front elevational view of a hair band assembly in accordance with a third preferred embodiment of the present invention.
Figure 8:
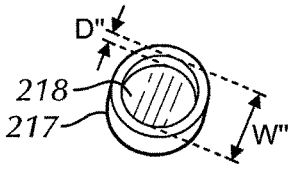
FIG. 8 is a top perspective view of a base of the hair band assembly of FIG. 7.

Referring to FIGS. 7 and 8, a third preferred embodiment of the hair clip assembly 210 is shown. Like reference numbers are utilized to identify like features of the hair clip assembly 210 of the third preferred embodiment in comparison to the hair clip assemblies 10, 110 of the first and second preferred embodiments with a "2" prefix utilized to identify the features of the third preferred hair clip assembly 210. The third preferred embodiment includes a hair band 212 for releasably fastening to a wearer's hair. The hair band 212 is preferably an elastomeric material capable of being stretched to allow a wearer to insert his or her hair into the hair band 212, which then retracts into a tight configuration when the wearer releases the hair band 212. The hair band 212 is also preferably coated with a soft, non-stick material, such as cotton, to enhance comfort for a wearer and reduce the possibility that hair will become tangled in the elastomeric material of the hair band 212. However, the hair band 212 may be constructed of and/or coated with any suitable material for fastening hair. The hair band 212 preferably contains a base 217 and magnetic portion 218 for receiving the second magnetic portion 22, 122 of the decorative portion 20, 120 of the first or second preferred embodiments of the invention. The magnetic portion 218 includes a base surface 218*a* and side walls 218*b*. The base 217 and magnetic portion 218 preferably have the same or similar shape, size, and other characteristics and capabilities of the magnetic portion 18 of the first preferred embodiment. The base 217 can alternately be configured as a decorative shape, such as a heart or flower, without deviating from the inventive concept.

Figure 9:
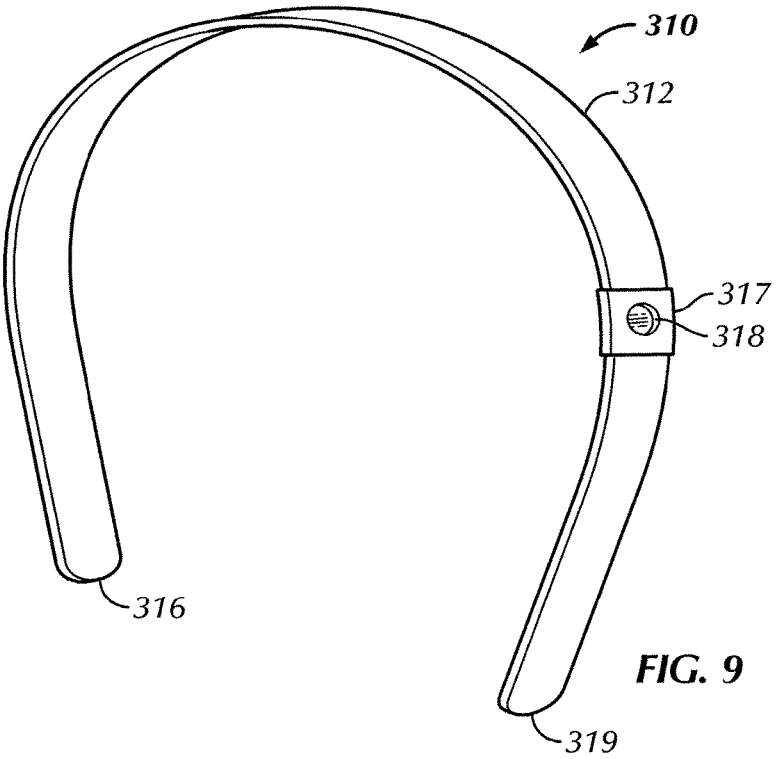
FIG. 9 is a front perspective view of a hair band assembly in accordance with a fourth preferred embodiment of the present invention.

Referring to FIG. 9, a fourth preferred embodiment of the hair clip assembly 310 is shown. Like reference numbers are utilized to identify like features of the hair clip assembly 310 of the fourth preferred embodiment in comparison to the hair clip assemblies 10, 110, 210 of the first, second and third preferred embodiments with a "3" prefix utilized to identify the features of the fourth preferred hair clip assembly 310. The fourth preferred embodiment includes a hair band 312 for releasably fastening hair and to the user's head. The hair band 312 is preferably a relatively rigid but flexible material, such as a polymeric material, configured in approximately a U-shape such that it can be placed over a wearer's head to secure the wearer's hair by gently hugging or squeezing the wearer's head between opposing first and second ends 316, 319 of the hair band 312. The hair band 312 preferably includes a base 317 and magnetic portion 318 for receiving the second magnetic portion 22, 122 of the decorative portion 20, 120 of the first or second preferred embodiments of the invention. The magnetic portion 318 preferably includes a base surface 318*a* and side walls 328*b*. The magnetic portion 318 of the base 317 is preferably configured as an indentation having the same or similar features of the indentation of the first magnetic portion 18 described with respect to the first preferred embodiment of the present invention. The base 317 can alternately be configured as a decorative shape, such as a heart or flower, without deviating from the inventive concept. The base 317 is also preferably constructed of a rigid polymeric material, but may be any material suitable for supporting the magnetic portion 318. The base 317 is also preferably slideable along the hair band 312 such that the wearer can fasten the decorative portion 20, 120 at any portion along the length of the hair band 312. The base 317 is preferably slideable via a sliding friction fit on the hair band 312 such that friction generally holds the base 317 in place until urged by the user to a different location, but is not so limited and may be configured for selective fastening in various locations along the hair band 312, by clamping or fastening. The hair band 312 preferably has stops (not shown) at or near its ends 316, 319 to prevent the base 317 from sliding off the hair band 312. The stops may be comprised of protrusions near the first and second ends 316, 319 or may comprise widening of the hair band 312 near the ends 316, 319 or along the length of the hair band 312.

Figure 10:
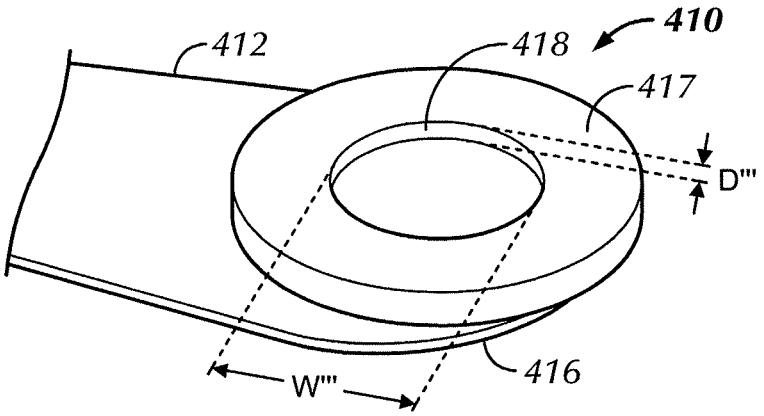
FIG. 10 is a magnified top perspective view of a hair clip assembly in accordance with a fifth preferred embodiment of the present invention.
Figure 11:
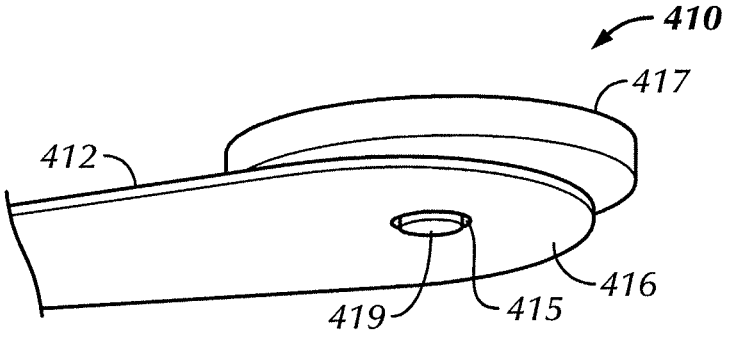
FIG. 11 is a bottom perspective view of the hair clip assembly of FIG. 10.

Referring to FIGS. 10-11, a fifth preferred embodiment of the hair clip assembly 410 is shown, having a hair clip 412 similar to that described with respect to the first preferred embodiment. Like reference numbers are utilized to identify like features of the hair clip assembly 410 of the fifth preferred embodiment in comparison to the hair clip assemblies 10, 110, 210, 310 of the first, second, third and fourth preferred embodiments with a "4" prefix utilized to identify the features of the fifth preferred hair clip assembly 410. In the fifth preferred embodiment, the hair clip 412 has a hole 415 at or near the first end 416. The fifth preferred embodiment further includes a cup 417 having a protrusion 419 on its bottom side and an indentation 418 on its opposing top side. The indentation 418 preferably includes a base surface 418*a* and side walls 418*b*. The indentation 418 preferably has the same or similar shape, size, and other characteristics and capabilities of the magnetic portion 18 of the first preferred embodiment. The cup 417 is preferably configured to mate with the hair clip 412 such that the protrusion 419 is approximately the same shape and size as the hole 415, preferably a circular shape approximately one-sixteenth of one inch (1/16") in diameter, and extends through the hole 415 to ensure the cup 417 is located in the correct position and is relatively laterally fixed. The cup 417 is preferably also secured to the hair clip 412 with glue or any other suitable means. The overall shape of the cup 417 may be a simple circle, as shown in FIGS. 10-11, or may be of a decorative shape such as a heart, flower, or any other shape desirable to a wearer.

Figure 12:
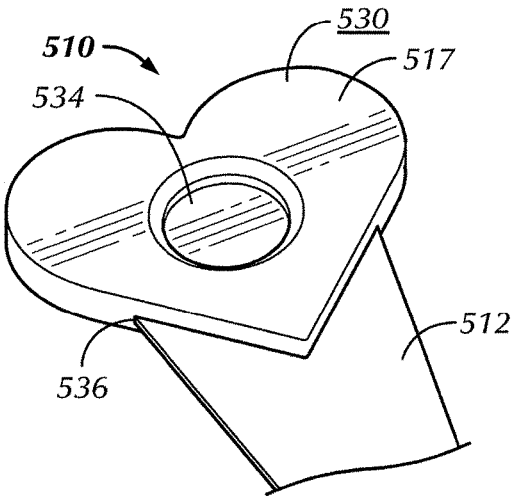
FIG. 12 is a magnified top perspective view of a hair clip assembly in accordance with a sixth preferred embodiment of the present invention.
Figure 13:
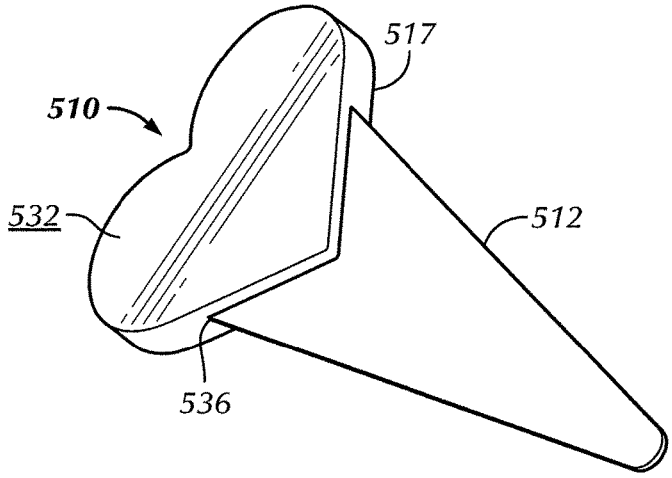
FIG. 13 is a bottom perspective view of the hair clip assembly of FIG. 12.
Figure 14:
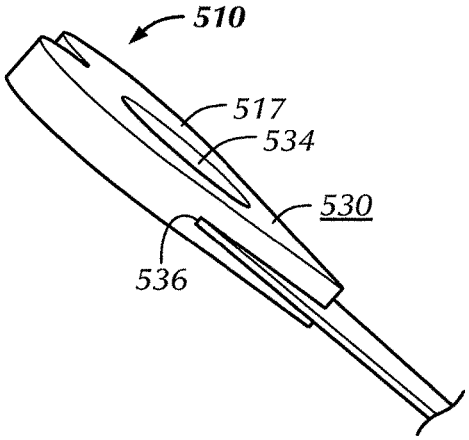
FIG. 14 is a side perspective view of the hair clip assembly of FIG. 12.

Referring to FIGS. 12-14, a sixth preferred embodiment of the hair clip assembly 510 is shown, having a hair clip 512 similar to that described with respect to the first preferred embodiment. Like reference numbers are utilized to identify like features of the hair clip assembly 510 of the sixth preferred embodiment in comparison to the hair clip assemblies 10, 110, 210, 310, 410 of the first, second, third, fourth, and fifth preferred embodiments with a "5" prefix utilized to identify and distinguish the features of the sixth preferred hair clip assembly 510. In the sixth preferred embodiment, the hair clip assembly 510 has a cup 517 having a top side 530 and a bottom side 532. The cup 517 preferably also has a hole 534 in the top side 530. The hole 534 preferably has the same or similar shape, size, and other characteristics and capabilities of the magnetic portion 18 of the first preferred embodiment. The cup 517 of the sixth preferred embodiment preferably further includes a slot 536 which runs substantially parallel to and is located between the top side 530 and the bottom side 532. The slot 536 is configured to receive first end of the hair clip 512 to ensure the cup 517 is located in the correct position and is relatively laterally fixed or secured to the hair clip 512. The cup 517 is preferably also secured to the hair clip 512 with glue, adhesive, force-fit, fastener or any other suitable means. The cup 517 is preferably constructed of a polymeric material, but may also be constructed of any suitable material without deviating from the inventive concept.

Figure 15:
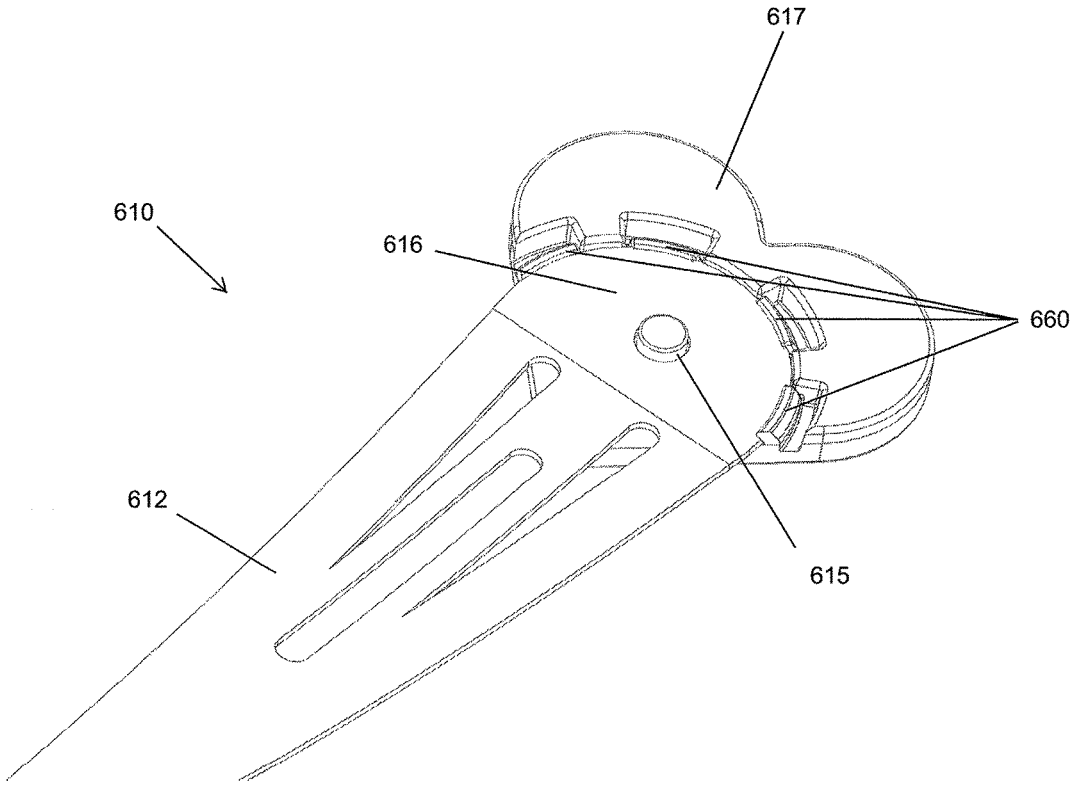
FIG. 15 is a bottom perspective view of a hair clip assembly in accordance with a seventh preferred embodiment of the present invention.
Figure 16:
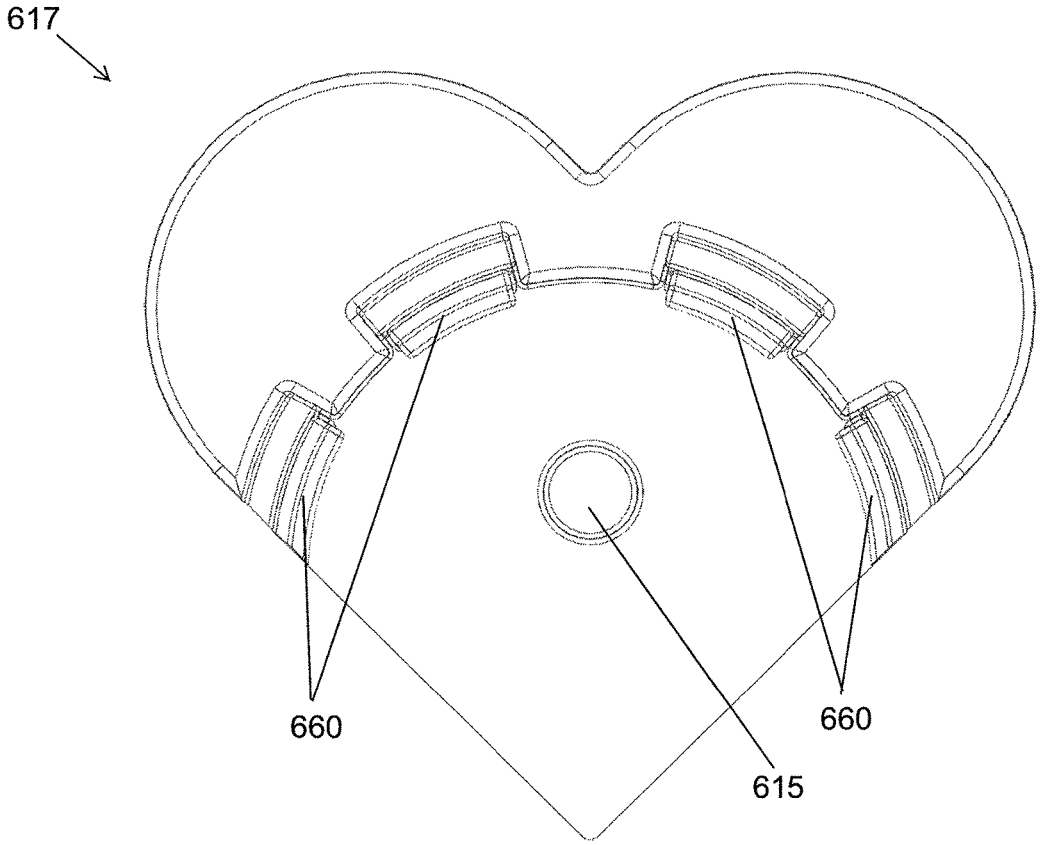
FIG. 16 is a bottom plan view of a portion of the hair clip assembly of FIG. 15.
Figure 17:
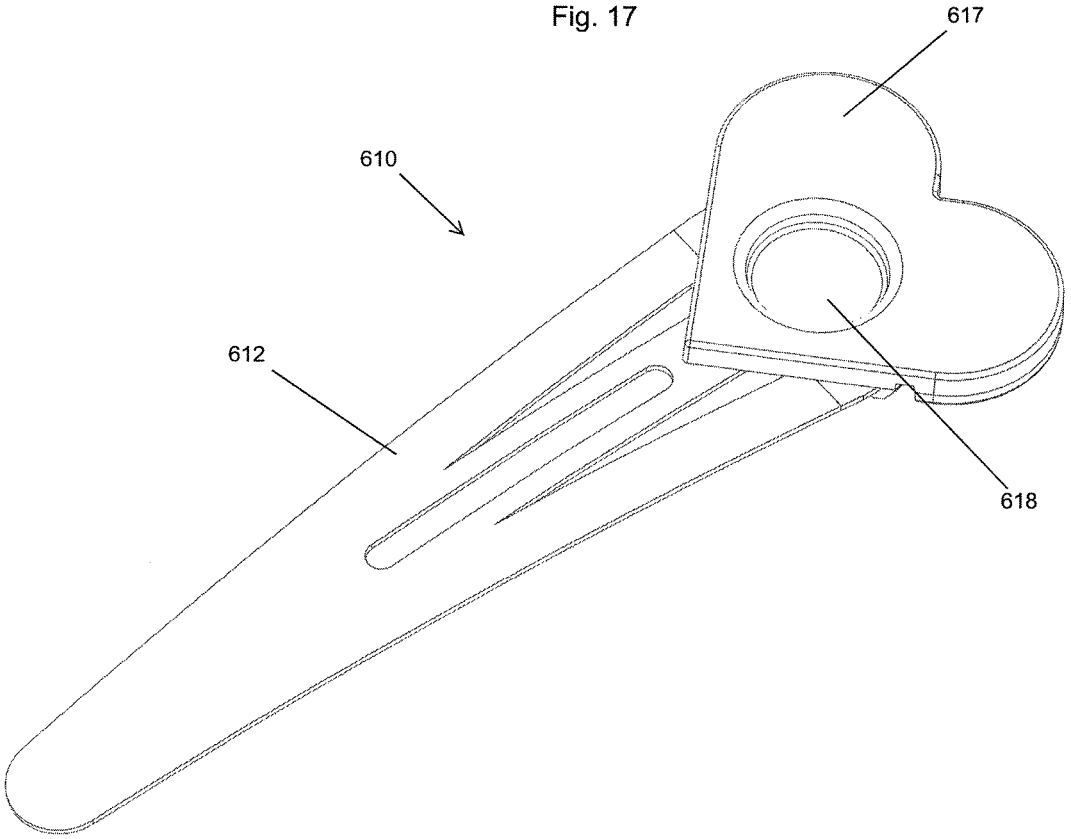
FIG. 17 is a top perspective view of the hair clip assembly of FIG. 15.

Referring to FIGS. 15-17, a seventh preferred embodiment of the hair clip assembly 610 is shown, having a hair clip 612 similar to that described with respect to the first preferred embodiment. Like reference numbers are utilized to identify like features of the hair clip assembly 610 of the seventh preferred embodiment in comparison to the hair clip assemblies 10, 110, 210, 310, 410, 510 of the first, second, third, fourth, fifth, and sixth preferred embodiments with a "6" prefix utilized to identify the features of the seventh preferred hair clip assembly 610. In the seventh preferred embodiment, the hair clip 612 has a hole 615 at or near the first end 616. The seventh preferred embodiment includes a cup 617 substantially similar to the cup 417 of the fifth preferred embodiment, but the cup 617 of the seventh preferred embodiment further includes teeth 660 for engagement with the first end 616 of the hair clip 612. The teeth 660 are preferably resilient to snap over the edge of the end of the hair clip 612 to secure the hair clip 612 to the cup 617. The teeth 660 preferably overlap the edge of the hair clip 612 to secure the hair clip 612 to the cup 617 in a mounted configuration. The cup 617 also preferably includes a first magnetic portion 618 having a depth D and width W to accommodate receipt of the second magnetic portion 22, 122. The cup 617 is preferably, but not necessarily, further secured to the hair clip 612 with glue or any other suitable adhesive. The overall shape of the cup 617 may be a simple circle (not shown) or may be a decorative shape such as a heart (as shown in FIGS. 15-17), flower, or any other shape desirable to a wearer.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the present disclosure.

I claim:

1. A hair clip assembly for connecting to a wearer's hair and providing a selective decorative aspect, the hair clip assembly comprising:

a hair clip configured to releaseably attach to a wearer's hair, the hair clip including a first end;

a cup having a top surface, a bottom surface, a slot running substantially parallel to the top and bottom surfaces and located between the top and bottom surfaces, and a hole in the top surface, the slot being engaged with the first end of the hair clip such that the cup is engaged to or near the first end of the hair clip in a mounted configuration;

a first decorative portion; and a magnetic portion secured to the first decorative portion, the hole configured as substantially the same shape and size as the magnetic portion such that the magnetic portion can be substantially fully inserted into the hole.

2. The hair clip assembly of claim 1, wherein the hole and the magnetic portion are generally cylindrical.

3. The hair clip assembly of claim 1, wherein the hole and the magnetic portion have a generally parallelepiped shape.

4. The hair clip assembly of claim 1, wherein the first end of the hair clip is constructed of a magnetic material.

5. The hair clip assembly of claim 1, wherein the first decorative portion is configured in a generally flower-like appearance.

6. The hair clip assembly of claim 1, further comprising:

a second decorative portion and a second magnetic portion attached to the second decorative portion.

7. The hair clip assembly of claim 1, wherein the hole includes a base surface and side walls.

8. The hair clip assembly of claim 1, wherein the hole has an indentation diameter, the indentation diameter being in a range of ¼ inch to ½ inch.

* * * * *